US008087941B2

(12) United States Patent
Liao et al.

(10) Patent No.: US 8,087,941 B2
(45) Date of Patent: Jan. 3, 2012

(54) GRID ARRAY CONNECTOR COMPRISING A PLURALITY OF BASE UNITS WITHIN A FRAME

(75) Inventors: Fang-Jwu Liao, Tu-Cheng (TW); Jia-Hau Liu, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 218 days.

(21) Appl. No.: 12/494,319

(22) Filed: Jun. 30, 2009

(65) Prior Publication Data

US 2009/0325399 A1 Dec. 31, 2009

(30) Foreign Application Priority Data

Jun. 30, 2008 (CN) ..... 097211551

(51) Int. Cl.
*H01R 12/00* (2006.01)

(52) U.S. Cl. ..... 439/66

(58) Field of Classification Search ..... 439/66, 439/70, 71, 592, 599, 715–717, 908
See application file for complete search history.

(56) References Cited

U.S. PATENT DOCUMENTS

| | | | | |
|---|---|---|---|---|
| 6,164,980 | A * | 12/2000 | Goodwin | 439/70 |
| 6,679,707 | B1 * | 1/2004 | Brodsky et al. | 439/71 |
| 6,805,562 | B2 * | 10/2004 | Liao et al. | 439/68 |
| 6,881,073 | B2 | 4/2005 | Bali et al. | |
| 6,929,505 | B2 * | 8/2005 | He et al. | 439/526 |
| 6,971,885 | B2 | 12/2005 | Mowry | |
| 7,044,746 | B2 * | 5/2006 | Copper et al. | 439/66 |
| 7,059,869 | B2 | 6/2006 | Wertz et al. | |
| 7,435,103 | B2 * | 10/2008 | Ma | 439/71 |
| 7,510,427 | B2 * | 3/2009 | Szu | 439/526 |
| 7,654,862 | B2 * | 2/2010 | Liao et al. | 439/526 |
| 7,666,002 | B2 * | 2/2010 | Lin et al. | 439/73 |
| 7,682,160 | B2 * | 3/2010 | Liao | 439/71 |
| 2004/0175967 | A1 * | 9/2004 | Liao | 439/68 |

* cited by examiner

*Primary Examiner* — Vanessa Girardi
(74) *Attorney, Agent, or Firm* — Wei Te Chung; Andrew C. Cheng; Ming Chieh Chang

(57) ABSTRACT

An electrical connector (1) for receiving an IC package is provided and includes a frame unit (2) having an opening (21) therein, at least two base units (3) received in the opening (21), and a plurality of contacts (4) retained in the base units (3) respectively. The base units move relative to one another by the force applied by the contacts therein.

6 Claims, 5 Drawing Sheets

GRID ARRAY CONNECTOR COMPRISING A PLURALITY OF BASE UNITS WITHIN A FRAME

BACKGROUND OF THE INVENTION

1. Field of the Invention

The present invention relates to an electrical connector for receiving an IC package, and more particularly to an electrical connector having at least one base unit movable in a frame unit.

2. Description of Prior Art

U.S. Pat. No. 7,044,746 issued to Charles et al. on May 16, 2006 disclosed an electrical connector for receiving an IC package, which includes a periphery frame and a base unit retained in the frame with a number of contacts received therein. To enable a balance force applied on the base unit by the IC package, the contacts are divided into two groups with opposite contact orientation, whereby the base unit will be pushed by the contacts along opposite directions when the contact deforms.

However, duo to high density of the contacts received in the base unit, the internal force applied on a substantial middle portion of the base unit is significant and is likely to cause breakage of the base unit.

Thus, there is a need to provide an improved electrical connector capable of prevent breakage of a base unit.

SUMMARY OF THE INVENTION

It is therefore the object of the present invention to provide an electrical connector having a movable base unit so as to prevent breakage of the base unit.

In accordance with the present invention, an electrical connector for receiving an IC package is provided and includes a frame unit having an opening therein, at least two base units received in the opening, and a plurality of contacts retained in the base units respectively. The base units move relative to one another by the force applied by the contacts therein.

BRIEF DESCRIPTION OF THE DRAWINGS

Other objects, advantages and novel features of the present invention will become more apparent from the following detailed description when taken in conjunction with the accompanying drawings, in which.

DETAILED DESCRIPTION OF PREFERRED EMBODIMENT

Figure 1:
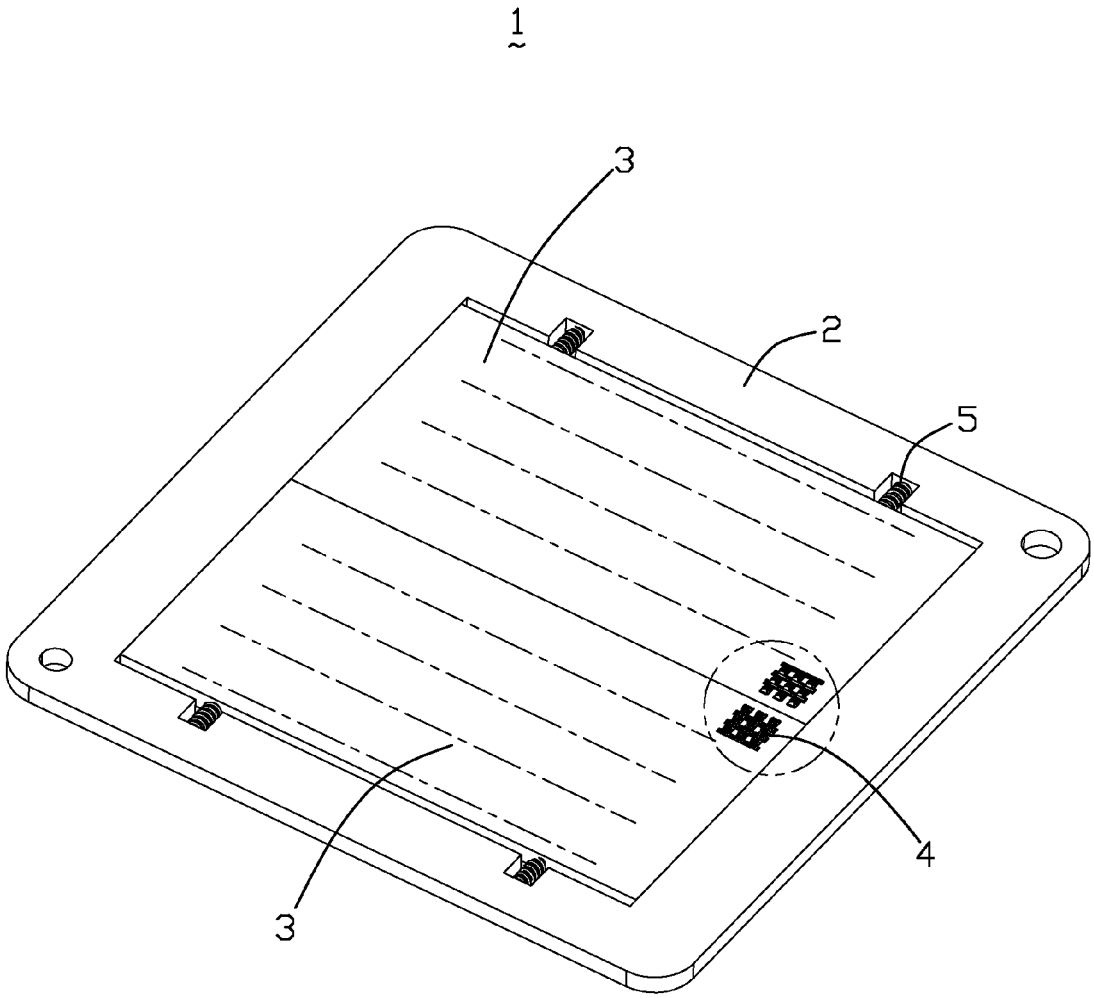
FIG. 1 is an assembled, perspective view of an electrical connector in accordance with a preferred embodiment of the present invention.
Figure 2:
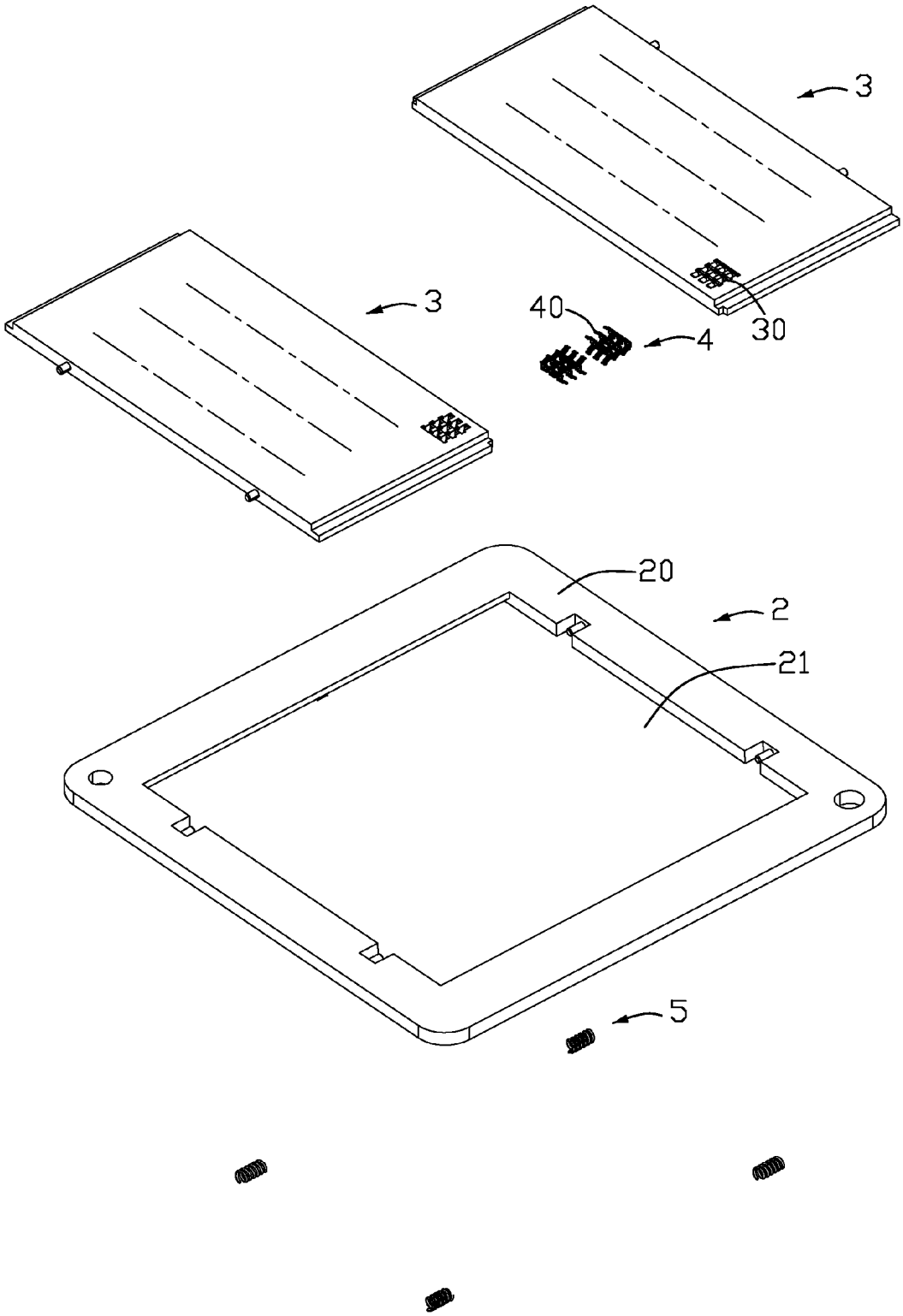
FIG. 2 is an exploded, perspective view of the electrical connector in accordance with the preferred embodiment.
Figure 3:
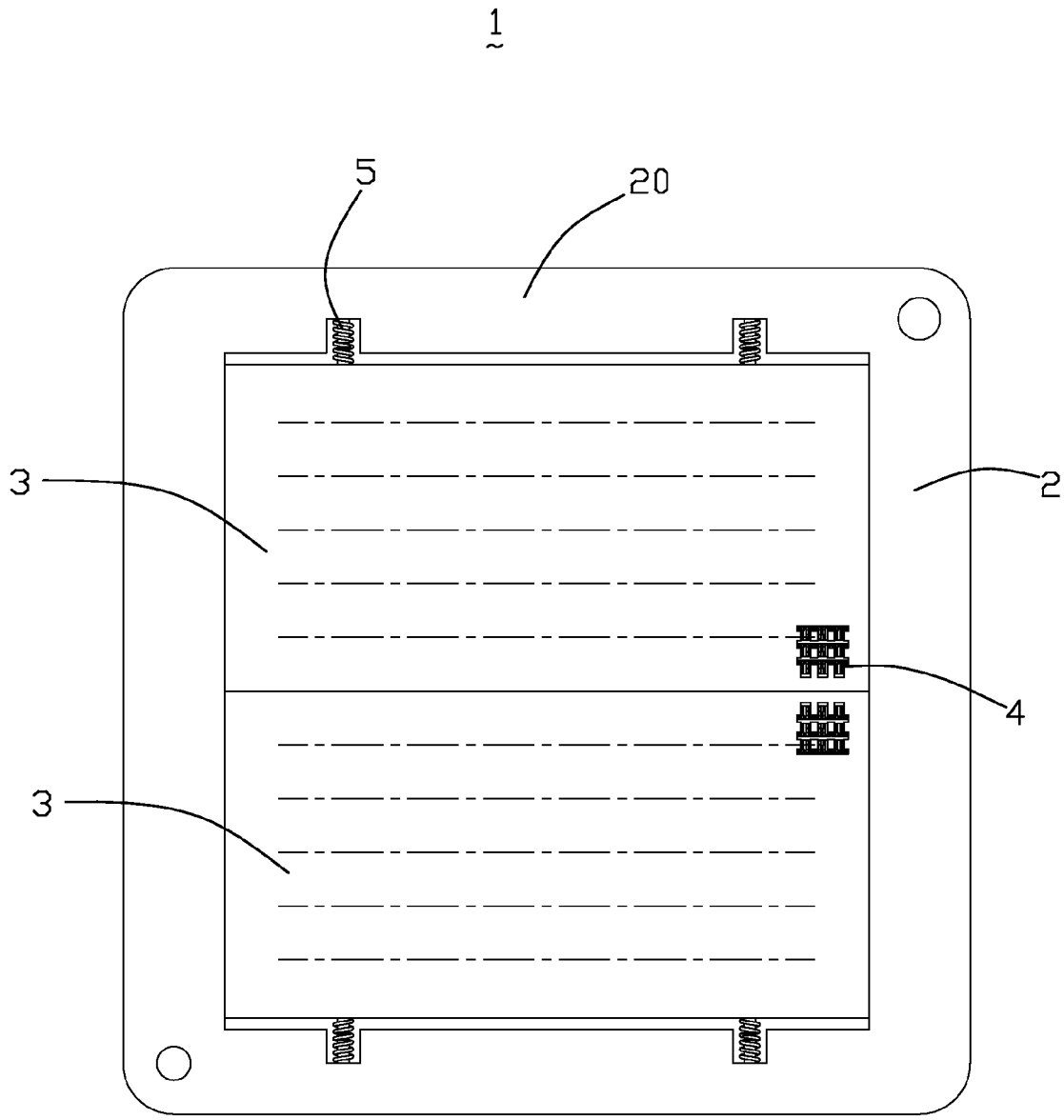
FIG. 3 is a top view of the electrical connector, in which two base units are in a first position and abutting against each other.
Figure 4:
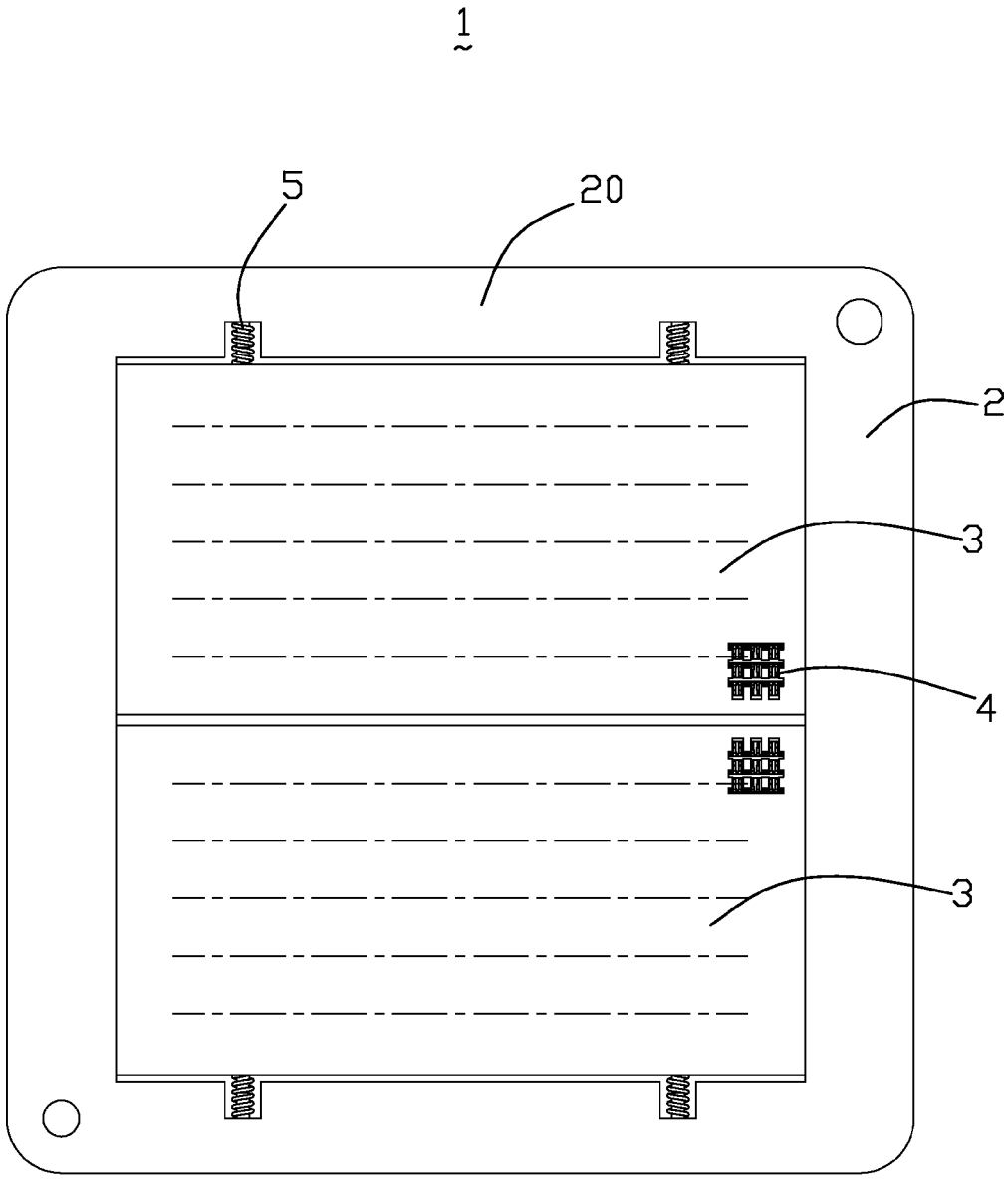
FIG. 4 is a top view of the electrical connector, in which two base units are in a second position and spaced from each other.
Figure 5:
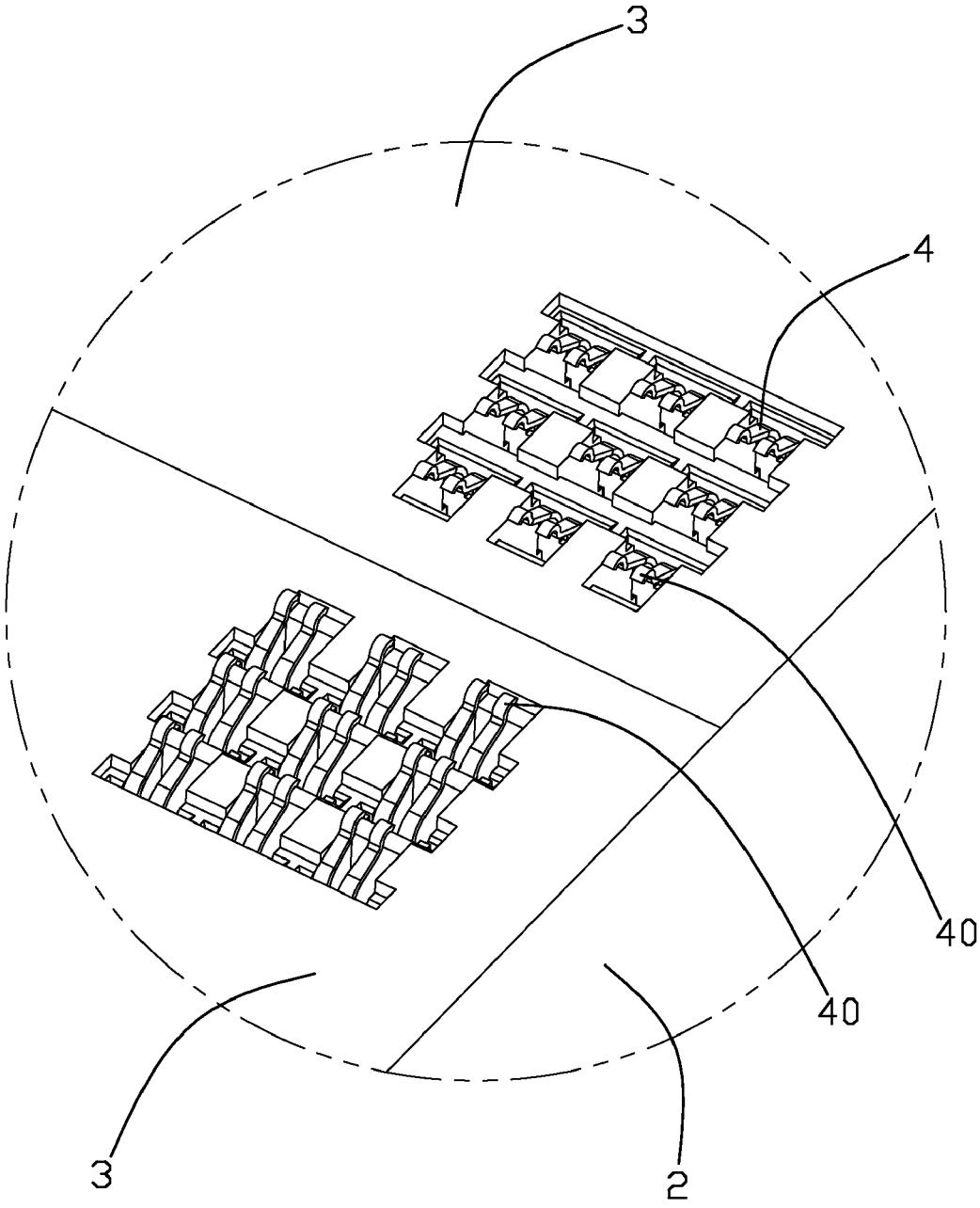
FIG. 5 is an enlarged view of a section of FIG. 1 labeled by a circle.

FIGS. 1-5 illustrate an electrical connector 1 made in accordance with a preferred embodiment of the present invention. The electrical connector 1 includes a rectangular frame unit 2 having four sidewalls 20 with an opening 21 therein. Two separate base units 3 of similar rectangular configuration are received in the opening 21 and arranged side by side. Each base unit 3 is further provided with a plurality of passageways 30 for retaining a plurality of contacts 4 therein respectively. The contacts 4 in different base units 3 have contacting arms (40) extending along opposition directions.

When an IC package (not shown) is not loaded into the electrical connector 1, the two base units 3 abut against each other without a substantial clearance therebetween, while each of the base units 3 is spaced from one sidewall 20 of the frame unit 2 with a clearance therebetween for receiving a pair of spring members 5. When the IC package is loaded and engages with the contacts 4, the two group of contacts 4 in different base units 3 deform downward and provide the base units 3 with opposite forces, which enabling the base units 3 to move away from one another along opposite directions while compressing the spring members 5. When the electrical connector 1 gets to a second position, the two base units 3 are in balance state by the engagements with the contacts 4 and the spring members 5, and are spaced from each otter with a clearance therebetween.

When the IC package is released from the electrical connector 1, the two base units 3 move toward each other due to the force provided by the compressed spring members 5, until reaching the original first position with the two base units 3 abutting against each other again.

Due to the movable base units 3, both of which has clearance for movement relative to the frame unit 2, the potential internal force is eliminated and the damaging of the base unit 3 is prevented when the IC package is loaded.

As an alternative embodiment, the electrical connector could be configured with only one movable base unit and a non-movable the base unit integrated with the frame unit. Same performance could be reached.

As a further alternative embodiment, the electrical connector could have four base units with contacts received therein extending along four different directions substantially evenly distributed around a circle. When the IC package is loaded and engages with the contacts, the four base units move toward sidewalls of the frame unit along such four different directions.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for receiving an IC package comprising:

a frame unit having an opening therein;

a pair of two base units received in the opening;

a plurality of contacts retained in the base units respectively; and a spring member engaging with at least one of the base unit;

wherein the base units move away from each other while compressing the spring member when the IC package is loaded and engages with the contacts, and move toward each other by the force provided by the spring member when the IC package is released from the contacts.

2. The electrical connector as claimed in claim 1, wherein the contacts in different base units have contacting arms extending along opposition directions.

3. The electrical connector as claimed in claim 2, wherein both of said two base units are separate from the frame unit and have clearance for movement in the opening of the frame unit.

4. The electrical connector as claimed in claim 3, wherein the frame unit is configured with four sidewalls, opposite two of which are respectively spaced from the base units with said spring members therebetween.

5. An electrical connector comprising:

an insulative base unit back and forth moveable in a first direction between first and second horizontal positions, and defining an upper face; and a plurality of contacts disposed in the base unit with contact sections extending upwardly beyond the upper face; wherein said contacts are configured for being depressed downwardly by an electronic package in a second direction perpendicular to said first direction, thus generating a transverse force urging said base unit to move from the first position toward the second position in said first direction;

further including a frame enclosing said base unit;

further including a spring to constantly urge the base unit to move from the second position to the first position in a third direction opposite to the first direction;

wherein said spring is located between the frame and the base unit.

6. An electrical connector comprising:

an insulative base unit back and forth moveable in a first direction between first and second horizontal positions, and defining an upper face; and a plurality of contacts disposed in the base unit with contact sections extending upwardly beyond the upper face; wherein said contacts are configured for being depressed downwardly by an electronic package in a second direction perpendicular to said first direction, thus generating a transverse force urging said base unit to move from the first position toward the second position in said first direction;

further including another base unit with another set of corresponding contacts for cooperating with said electronic package, wherein said another unit is back and forth moveable in the first direction in an opposite manner with regard to the base unit;

further including two sets of springs to respectively urge said base unit and said another base unit toward each other.

* * * * *